US009891572B2

(12) United States Patent
Uchiyama

(10) Patent No.: US 9,891,572 B2
(45) Date of Patent: Feb. 13, 2018

(54) PAPER HUMIDIFYING APPARATUS AND IMAGE FORMING SYSTEM

(71) Applicant: Konica Minolta, Inc., Chiyoda-ku, Tokyo (JP)

(72) Inventor: Masaaki Uchiyama, Sagamihara (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/165,374

(22) Filed: May 26, 2016

(65) Prior Publication Data

US 2016/0349700 A1 Dec. 1, 2016

(30) Foreign Application Priority Data

May 28, 2015 (JP) ..... 2015-108214

(51) Int. Cl.
*G03G 21/00* (2006.01)
*G03G 15/00* (2006.01)
(Continued)

(52) U.S. Cl.
CPC ..... *G03G 15/6576* (2013.01); *B65H 23/34* (2013.01); *G03G 15/6573* (2013.01);
(Continued)

(58) Field of Classification Search
CPC ..... G03G 15/6576; G03G 2215/00426; G03G 2215/00662; G03G 15/6573;
(Continued)

(56) References Cited

U.S. PATENT DOCUMENTS 5,937,258 A * 8/1999 Acquaviva ..... G03G 15/6573 399/341
6,011,947 A * 1/2000 Acquaviva ..... B05C 1/0834 399/341
(Continued)

FOREIGN PATENT DOCUMENTS

JP 05337412 A 12/1993
JP 08309250 A 11/1996
(Continued)

OTHER PUBLICATIONS

Notification of Reasons for Refusal for related Japanese Patent Application No. 2015-108214; dated May 23, 2017.

*Primary Examiner* — Robert Beatty
(74) *Attorney, Agent, or Firm* — Cantor Colburn LLP

(57) ABSTRACT

A paper humidifying apparatus includes humidifying rollers, a first drive unit and a controller. The humidifying rollers, forming a pair, are pressed against each other forming a nip portion and apply moisture to a sheet of paper when sandwiching and conveying the sheet of paper. The first drive unit which makes the humidifying rollers separate from each other or press against each other. The controller controls the first drive unit. The controller controls the first drive unit so as to make the humidifying rollers separate from each other and receive the sheet of paper, and after a tip of the sheet of paper passes a position corresponding to the nip portion, the controller controls the first drive unit so as to make the humidifying rollers press against each other to apply moisture to the sheet of paper.

9 Claims, 7 Drawing Sheets

(51) Int. Cl.
*G03G 21/20* (2006.01)
*B65H 23/34* (2006.01)

(52) U.S. Cl.
CPC ... *G03G 21/203* (2013.01); *G03G 2215/0067* (2013.01); *G03G 2215/00426* (2013.01); *G03G 2215/00662* (2013.01)

(58) Field of Classification Search
CPC ..... G03G 15/5029; G03G 15/6594; G03G 2215/0067; G03G 2215/00481; G03G 2215/00485; B65H 23/34
USPC ..... 399/341, 406; 162/270, 271
See application file for complete search history.

(56) References Cited

U.S. PATENT DOCUMENTS 7,510,610 B2 * 3/2009 Kougami ..... G03G 15/6573 101/132.5
7,515,862 B2 * 4/2009 Shida ..... B65H 37/00 399/341
8,280,298 B2 * 10/2012 Kougami ..... G03G 15/6573 162/DIG. 6
8,290,419 B2 * 10/2012 Ogushi ..... G03G 15/6576 399/341
2007/0048048 A1 * 3/2007 Kougami ..... G03G 15/6576 399/341
2008/0044207 A1 * 2/2008 NakaJima ..... G03G 15/6576 399/341
2009/0245908 A1 * 10/2009 Shida ..... G03G 15/6576 399/407
2012/0034007 A1 * 2/2012 Kougami ..... G03G 15/6573 399/361
2015/0205258 A1 * 7/2015 Sugaya ..... G03G 15/6576 399/341
2016/0200534 A1 * 7/2016 Wang ..... B65H 5/023 271/265.01
2016/0357143 A1 * 12/2016 Wang ..... G03G 21/203

FOREIGN PATENT DOCUMENTS

JP 09080923 A * 3/1997
JP 2006151665 A * 6/2006
JP 2007292914 A * 11/2007
JP 2010030700 A * 2/2010
JP 2011090243 A 5/2011
JP 2014191311 A 10/2014
JP 6112731 B2 4/2017

* cited by examiner

T1

| BASIS WEIGHT[g/m$^2$] | LENGTH[mm] |
|---|---|
| 50~60 | 10 |
| 61~70 | 5 |
| 71~ | 0 |

PAPER HUMIDIFYING APPARATUS AND IMAGE FORMING SYSTEM

CROSS REFERENCE TO RELATED APPLICATIONS

The present invention claims priority under 35 U.S.C. § 119 to Japanese Application No. 2015-108214, filed May 28, 2015, the entire content of which is incorporated herein by reference.

BACKGROUND OF THE INVENTION

Field of the Invention

The present invention relates to a paper humidifying apparatus and an image forming system.

Description of Related Art

In the case where a process that involves heating of paper, such as a fixing process performed in an electrophotographic image forming apparatus, is included in image forming, sheets of paper tend to curve, such as becoming wavy, as a result of uneven moisture distribution in each of the sheets of paper due to moisture evaporating from the sheets of paper when heated.

In the aim of solving the above problem, there is known a paper processing apparatus which includes a humidifying unit for applying moisture to sheets of paper after image forming and which corrects curves in sheets of paper by passing them through a wavy concavo-convex unit after moisture has been applied to the sheets of paper by the humidifying unit (for example, see JP 2011-90243).

FIG. 10 is a view showing an example configuration of a humidifying unit in a paper processing apparatus.

The humidifying unit 500 includes a pair of humidifying rollers 501 and 501, water supply rollers 502 and 502 which transmit water to the humidifying rollers 501 and 501 and reservoir units 503 and 503 in which water that is to be supplied to the water supply rollers 502 and 502 is pooled, for example. Moisture is to be applied to sheets of paper P by sandwiching and conveying the sheets of paper P with the humidifying rollers 501 and 501 whose outer circumferences hold moisture.

However, in the above described humidifying unit 500, there is a possibility that paper conveyance be unstable when sandwiching and conveying a sheet of paper P with the pair of humidifying rollers 501 and 501 as a result of the sheet of paper P and the humidifying rollers 501 and 501 becoming highly adhesive to each other and the sheet of paper P winding around one of the humidifying rollers 501 and 501 as shown by the dashed line in FIG. 10.

SUMMARY OF THE INVENTION

The present invention was made in view of the above problem, and an object of the present invention is to provide a paper humidifying apparatus and an image forming system which can stably convey sheets of paper to which moisture is applied.

To solve the object described above, according to one aspect of the present invention, there is provided a paper humidifying apparatus, including: humidifying rollers, forming a pair, which are pressed against each other forming a nip portion and which apply moisture to a sheet of paper when sandwiching and conveying the sheet of paper; a first drive unit which makes the humidifying rollers separate from each other or press against each other; and a controller which controls the first drive unit, wherein the controller controls the first drive unit so as to make the humidifying rollers separate from each other and receive the sheet of paper, and after a tip of the sheet of paper passes a position corresponding to the nip portion, the controller controls the first drive unit so as to make the humidifying rollers press against each other to apply moisture to the sheet of paper.

Preferably, the paper humidifying apparatus further includes: water supply rollers which supply moisture to outer circumferences of the humidifying rollers; water removing units which wipe off moisture on the outer circumferences of the humidifying rollers; a second drive unit which makes the water supply rollers separate from or come in contact with the humidifying rollers; and a third drive unit which makes the water removing units separate from or come in contact with the humidifying rollers, wherein before the humidifying rollers receive the sheet of paper, the controller controls the second drive unit so as to make the water supply rollers separate from the humidifying rollers and controls the third drive unit so as to make the water removing units come in contact with the humidifying rollers to wipe off the moisture on the humidifying rollers.

Preferably, in the paper humidifying apparatus, the controller controls the second drive unit so as to make the water supply rollers separate from the humidifying rollers and thereafter, the controller controls the first drive unit so as to make the humidifying rollers separate from each other.

Preferably, in the paper humidifying apparatus, after the tip of the sheet of paper passes a predetermined distance from the position corresponding to the nip portion, the controller controls the first drive unit so as to make the humidifying rollers press against each other.

Preferably, in the paper humidifying apparatus, the controller sets the predetermined distance on a basis of a paper condition.

Preferably, in the paper humidifying apparatus, the controller sets the predetermined distance so as to be longer as a basis weight, which is the paper condition, be smaller.

Preferably, in the paper humidifying apparatus, the water removing units do not come in contact with the humidifying rollers when the humidifying rollers are separated from each other.

Preferably, the paper humidifying apparatus further includes an operation unit for a user to set operation timing of the humidifying rollers.

According to another aspect of the present invention, there is provided an image forming system, including: an image forming unit for forming an image on a sheet of paper; and the paper humidifying apparatus for humidifying the sheet of paper on which the image is formed by the image forming unit.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
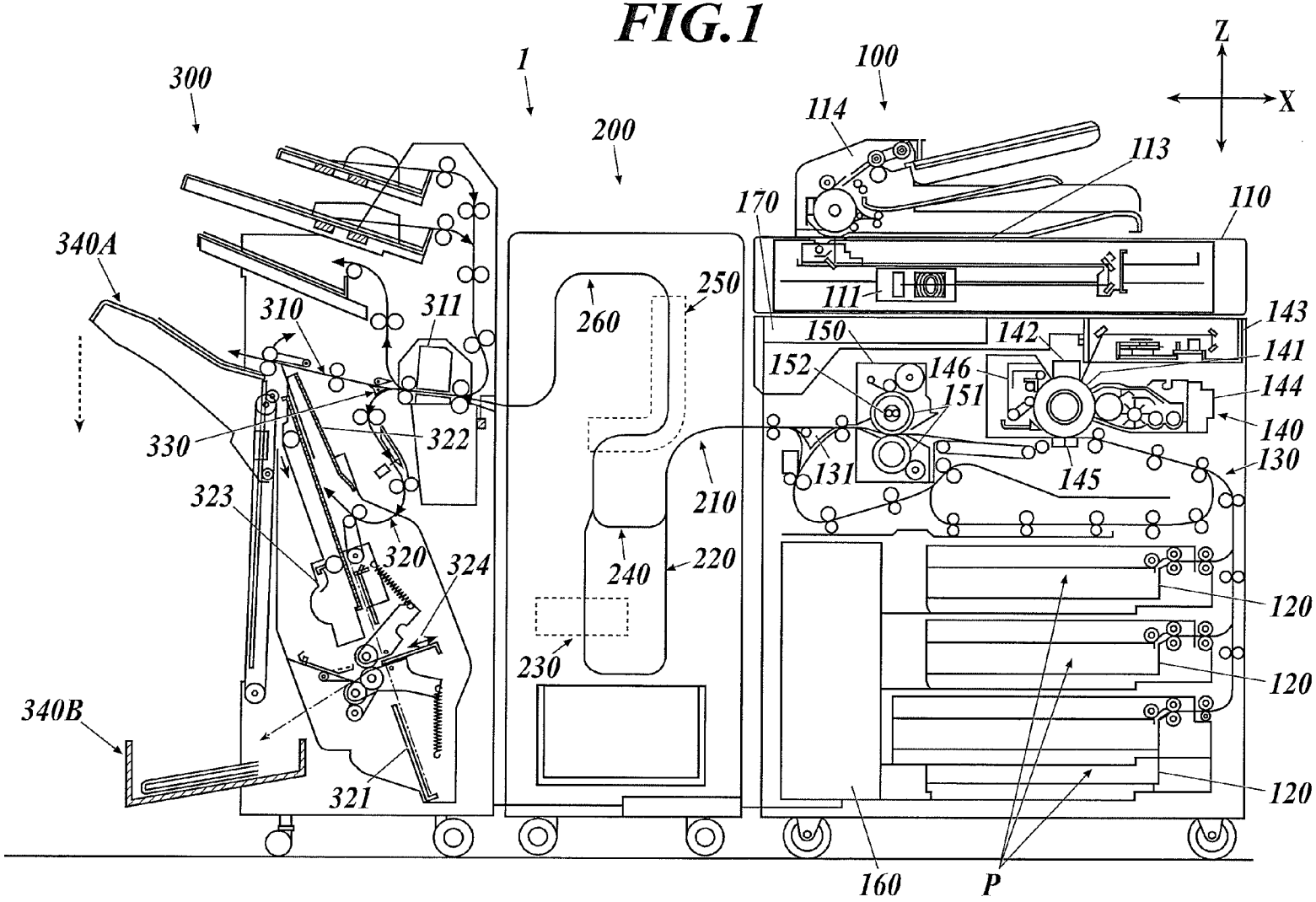
FIG. 1 is a schematic view showing the overall structure of an image forming system.

Hereinafter, an embodiment of the present invention will be described with reference to the drawings. However, the scope of the invention is not limited to the examples shown in the drawings in any way.

[Image Forming System]

Figure 2:
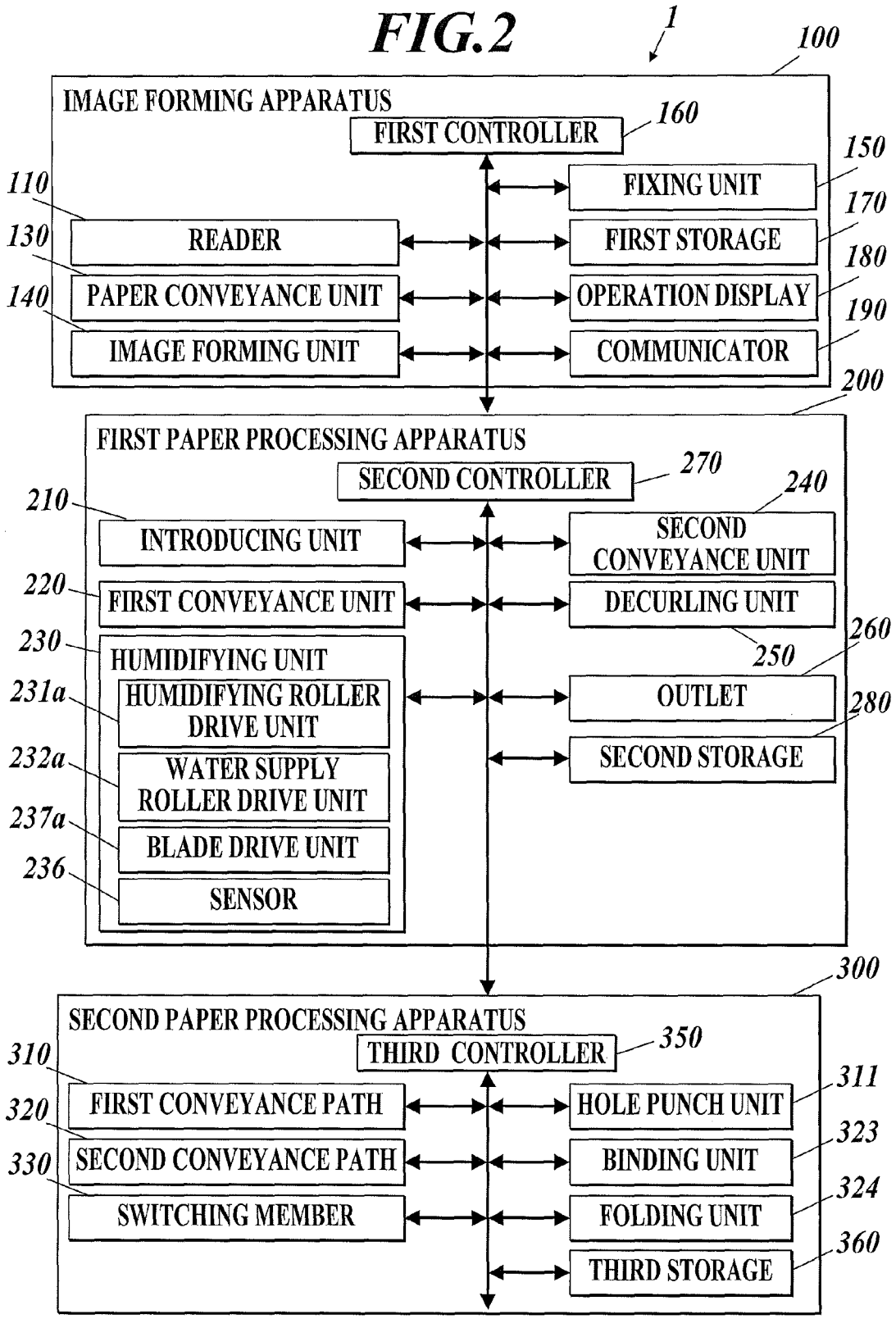
FIG. 2 is a block diagram showing the main configuration relating to operational control of the image forming system.

FIG. 1 is a schematic view showing the overall structure of the image forming system 1 according to the embodiment and FIG. 2 is a block diagram showing the main configuration relating to operational control of the image forming system 1.

As shown in FIGS. 1 and 2, the image forming system 1 includes an image forming apparatus 100, a first paper processing apparatus 200 and a second paper processing apparatus 300.

The image forming apparatus 100 is an apparatus which forms images on sheets of paper P.

The first paper processing apparatus 200 is a paper humidifying apparatus which performs a humidifying process to apply moisture to sheets of paper P on which images are formed by the image forming apparatus 100.

The second paper processing apparatus 300 is an apparatus which performs a hole punching process, a binding process and a folding process on sheets of paper P on which images are formed by the image forming apparatus 100.

In the following description, the direction in which the image forming apparatus 100, the first paper processing apparatus 200 and the second paper processing apparatus 300 are connected is referred to as the X direction, the vertical direction is referred to as the Z direction and the direction orthogonal to the X direction and the Z direction is referred to as the Y direction.

[Image Forming Apparatus]

First, the image forming apparatus 100 will be described.

As shown in FIGS. 1 and 2, the image forming apparatus 100 includes a reader 110, paper feeding trays 120, a paper conveyance unit 130, an image forming unit 140, a fixing unit 150, a first controller 160, a first storage 170, an operation display (operating unit) 180, a communicator 190 and the like, for example.

The reader 110 optically reads a document and generates image data.

In particular, the reader 110 includes a sensor 111, a generator, a platen 113, an auto document feeder (ADF) 114 and the like. The sensor 111 includes an image pickup device such as a CCD (Charge-Coupled Device) image sensor or a CMOS (Complementary Metal Oxide Semiconductor) image sensor to read images and output electric signals according to the read images. The generator, which is not shown in the drawings, generates image data on the basis of the electric signals output from the sensor 111. The platen 113 includes a light transmissive plate-like member which is disposed on the side of the sensor 111 where documents are to be read, and a document can be placed on the plate-like member. The auto document feeder 114 conveys documents so as to move the documents in relation to the sensor 111. The sensor 111 reads a document which is placed on the platen 113. The sensor 111 also reads the documents which are conveyed by the auto document feeder 114.

The paper feeding trays 120 are box-shaped members in which sheets of paper P can be contained, the trays being arranged so that their storage condition or their open condition with respect to the case of the image forming apparatus 100 can be switched. In the paper feeding trays 120, sheets of paper P before images are formed thereon by the image forming apparatus 100 are contained. As shown in FIG. 1, a plurality of paper feeding trays 120 are disposed and each of the trays contains sheets of paper P of a different size. Here, the plurality of paper feeding trays 120 can also contain sheets of paper P of the same size.

The paper conveyance unit 130 conveys sheets of paper P between the paper feeding trays 120, the image forming unit 140, the fixing unit 150 and the like.

In particular, the paper conveyance unit 130 includes a plurality of rollers and drive units (not shown) which drive individual rollers, for example. The rollers are disposed intermittently between the paper feeding trays 120, the image forming unit 140, the fixing unit 150 and the like and theiraround along a predetermined paper conveyance path. The paper conveyance unit 130 pulls out the sheets of paper P which are contained in the paper feeding trays 120 one by one and conveys the sheets of paper P to the image forming unit 140. Thereafter, the paper conveyance unit 130 conveys the sheets of paper P on which images are formed by the image forming unit 140 to the fixing unit 150 and then, outputs the sheets of paper P on which the images are fixed by the fixing unit 150 from the outlet which is formed on the side of the image forming apparatus 100 facing the first paper processing apparatus 200. In the case where image forming is to be performed on both sides of a sheet of paper P, the paper conveyance unit 130 operates so as to reverse a sheet of paper P at the branching point 131 on the conveyance path between the fixing unit 150 and the outlet and to make the sheet of paper P return toward the image forming unit 140.

The image forming unit 140 forms images on sheets of paper P.

In particular, the image forming unit 140 includes a photoreceptor 141, a charger 142, an exposure unit 143, a developing unit 144, a transfer unit 145 and a cleaner 146, for example. The photoreceptor 141 is disposed so that the outer circumference thereof comes in contact with a sheet of paper P which is conveyed by the paper conveyance unit 130. The charger 142 performs a charging process on the photoreceptor 141. The exposure unit 143 performs an exposure process according to image data on the charged photoreceptor 141. The developing unit 144 forms a toner image according to image data and transfers (primary transfer) the toner image on to the photoreceptor 141. The transfer unit 145 transfers (secondary transfer) the toner image which is transferred on to the photoreceptor 141 on to a sheet of paper P. The cleaner 146 removes the residual toner remaining on the photoreceptor 141. The image forming unit 140 of the embodiment performs electrophotographic image forming with the above described configuration. However, this is just an example and is not limitative in any way. For example, the image forming unit 140 can include an inkjet or the like for performing image forming of other methods.

The image forming unit 140 shown in FIG. 1 includes one developing unit 144 and performs monochromatic image forming (single color). However, this is just an example and is not limitative in any way. For example, the image forming unit 140 can include developing units 144 corresponding to cyan (C), magenta (M), yellow (Y) and black (K) and can perform color printing using combinations of these colors.

The fixing unit 150 fixes the image formed on a sheet of paper P by the image forming unit 140.

In particular, the fixing unit 150 includes a pair of fixing rollers 151 and 151 and a heater 152, for example. The fixing rollers 151 and 151, which form a pair, are arranged so that the outer circumferences thereof come in contact with each other while the conveyance path of sheets of paper P passes between the rollers 151 and 151. The heater 152 heats one roller of the pair of fixing rollers 151 and 151 that comes in contact with the side of a sheet of paper P on which an image is formed by the image forming unit 140 (the roller on the upper side in FIG. 1, for example). The fixing unit 150 fixes the toner image which is transferred on to a sheet of paper P by sandwiching the sheet of paper P with the pair of fixing rollers 151 and 151 which is driven to rotate and by conveying the sheet of paper P while heating the side of the sheet of paper P on which an image is formed with the roller that is heated by the heater 152.

The first controller 160 integrally controls the apparatuses and units of the image forming system 1 according to instructions that are input through the operation display 180 or the communicator 190. The first controller 160 includes a CPU (Central Processing Unit), a RAM (Random Access Memory) and the like. The CPU reads a program stored in the first storage 170 and opens the program in a work area in the RAM. In such way, the CPU carries out various processes in cooperation with programs.

For example, the first controller 160 makes the image forming apparatus 100 perform image forming and the like on sheets of paper P on the basis of image data obtained via the reader 110.

Programs to be executed by the first controller 160 and data necessary to execute the programs are stored in the first storage 170.

The operation display 180 includes a touch panel which displays various information relating to operation of the image forming system 1 and which detects various input operation performed by a user according to the displayed content, a plurality of switches for a user to perform various input operation, and the like.

For example, the operation display 180 is used for inputting a paper condition and the like relating to operation of the humidifying unit 230 of the first paper processing apparatus 200.

With respect to the processes performed in the image forming apparatus 100, the first paper processing apparatus 200 and the second paper processing apparatus 300, various settings that are input by a user through the operation display 180 are to be stored in the storages (the first storage 170, the second storage 280 and the third storage 360) of the individual apparatuses.

The communicator 190 includes a Network Interface Card (NIC) or a configuration equivalent to this, for example, and is used for carrying out communication between the image forming system 1 and other computers. When a printing job including image data is input via the communicator 190, the first controller 160 performs image forming and the like on the basis of the printing job.

A sheet of paper P which is output from the image forming apparatus 100 is to be conveyed to the first paper processing apparatus 200.

[First Paper Processing Apparatus]

Next, the first paper processing apparatus 200 will be described.

Figure 3:
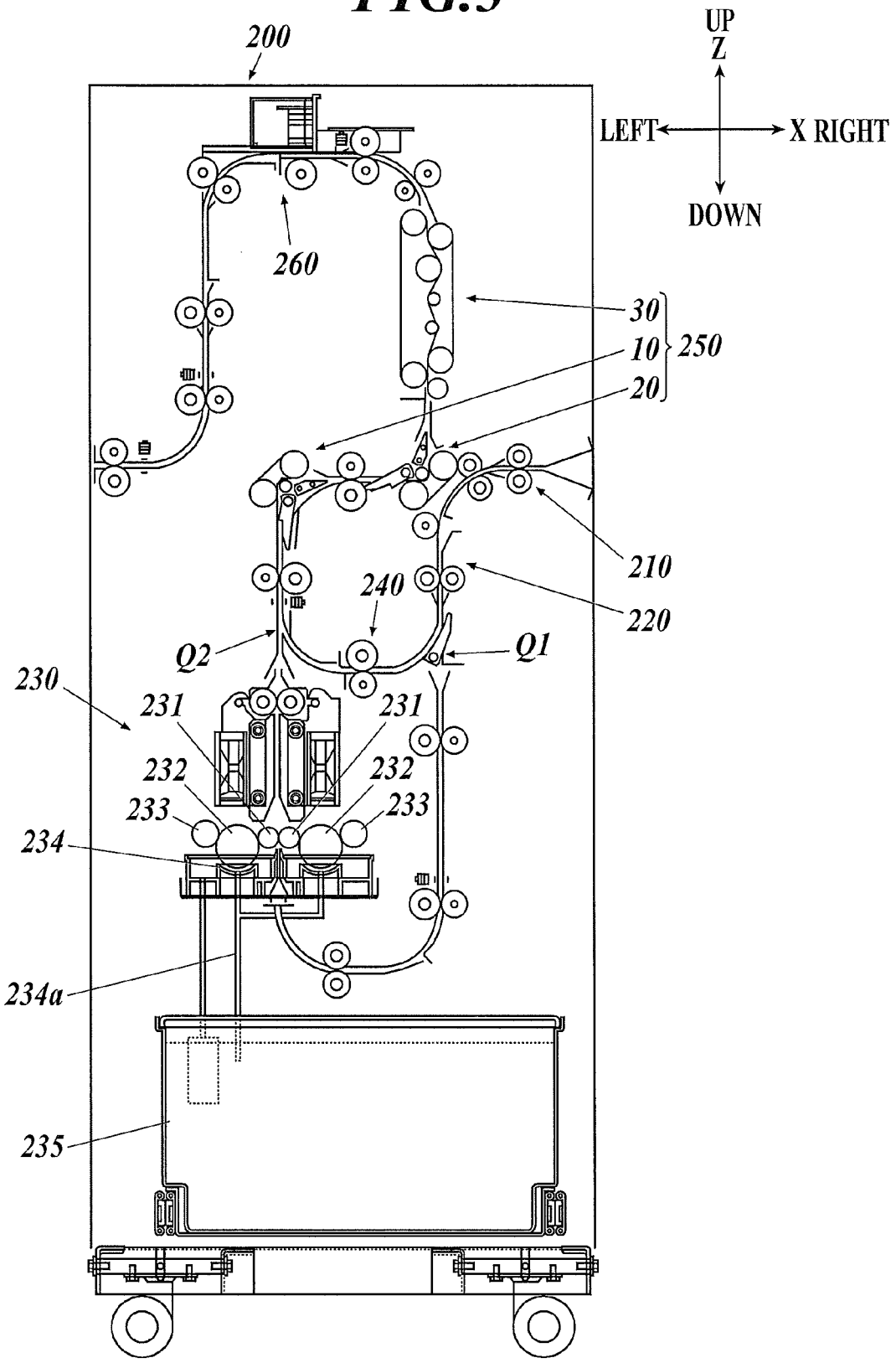
FIG. 3 is a view showing the main configuration in a first paper processing apparatus.

FIG. 3 is a view showing the main configuration of the first paper processing apparatus 200.

As shown in FIGS. 2 and 3, the first paper processing apparatus 200 includes an introducing unit 210, a first conveyance unit 220, a humidifying unit 230, a second conveyance unit 240, a decurling unit 250, an outlet 260, a second controller 270 and a second storage 280, for example.

In the following description, the X direction will be referred to in terms of left and right and the Z direction will be referred to in terms of up and down. The right side is the side on which the image forming apparatus 100 is arranged with respect to the first paper processing apparatus 200. The left side is the side on which the second paper processing apparatus 300 is arranged with respect to the first paper processing apparatus 200. The upper side is the side in the direction toward the outlet 260 in the first paper processing apparatus 200. The lower side is the side in the direction toward the humidifying unit 230 in the first paper processing apparatus 200.

The introducing unit 210 receives sheets of paper P which are output from the image forming apparatus 100 in to the first paper processing apparatus 200.

The first conveyance unit 220 conveys the sheets of paper P which are received in to the first paper processing apparatus 200 by the introducing unit 210 to the humidifying unit 230 which is disposed below the introducing unit 210. In the middle of the first conveyance unit 220, the branching point Q1 which is a branching point on the conveyance path for guiding sheets of paper P to the second conveyance unit 240 is arranged.

Figure 4:
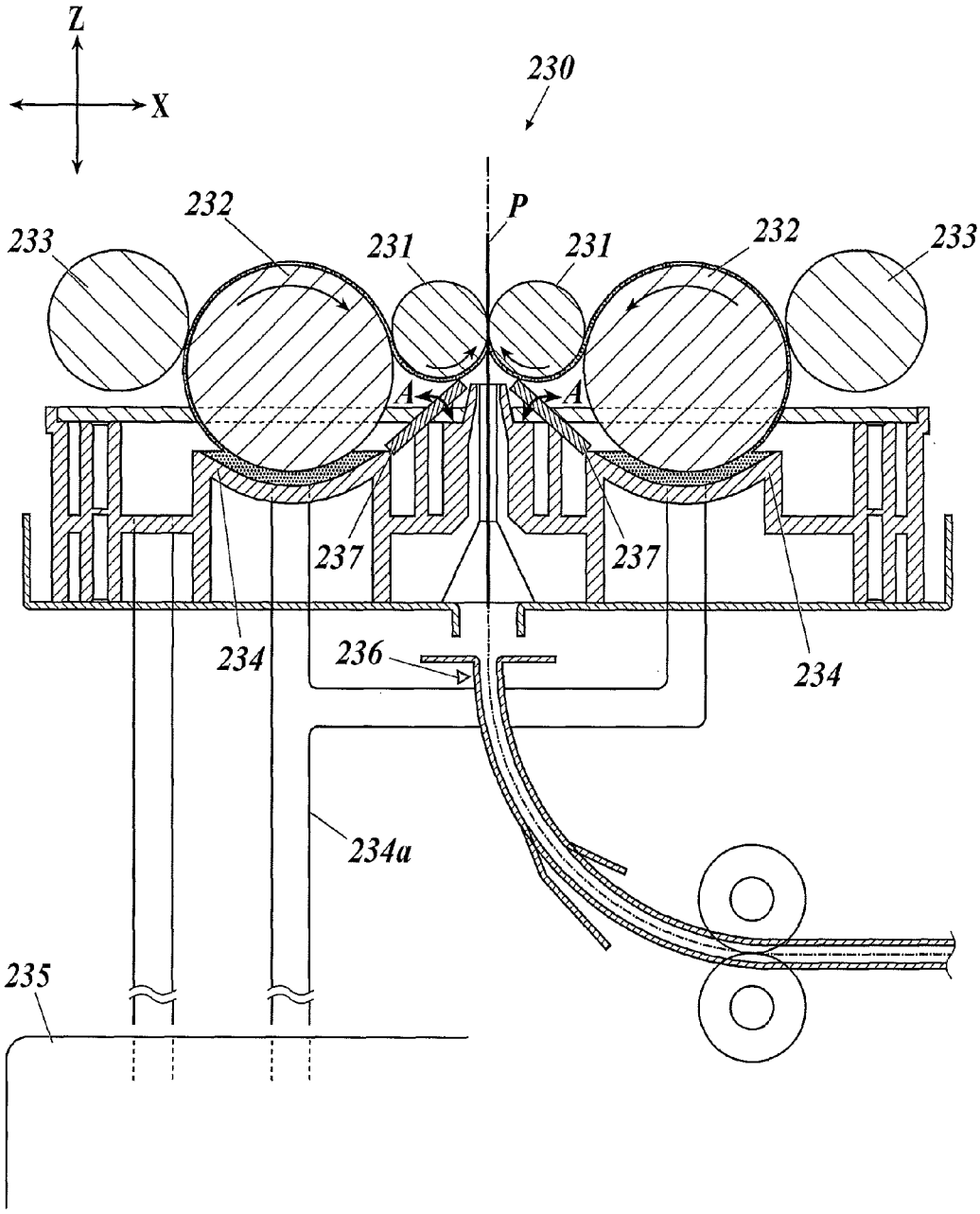
FIG. 4 is a significant part enlarged view showing the configuration of a humidifying unit.

FIG. 4 is a significant part enlarged view showing the configuration of the humidifying unit 230.

The humidifying unit 230 is for applying moisture to sheets of paper P which are conveyed by the first conveyance unit 220. The humidifying unit 230, for example, includes a pair of humidifying rollers 231 and 231 which forms a nip portion by being pressed against each other, water supply rollers 232 and 232 which transmit water to the humidifying rollers 231 and 231, water removing rollers 233 and 233 which remove excess water on the water supply rollers 232 and 232, reservoir units 234 and 234 in which water that is to be transmitted to the water supply rollers 232 and 232 is pooled, a tank 235 in which water is stored, a sensor 236 which is disposed on the upper stream side of the humidifying rollers 231 and 231, blades 237 and 237 which remove excess water on the humidifying rollers 231 and 231 and the like.

The humidifying rollers 231 and 231 that form a pair are two long rollers which extend in the width direction (Y direction) of a sheet of paper P. In a state where the humidifying rollers 231 and 231 are made to press against each other, they are driven by the driving motor so as to rotate, and they sandwich and convey a sheet of paper. Here, it is controlled so that the rotation speed of the pair of humidifying rollers 231 and 231 (conveyance speed of a sheet of paper) be constant.

The pair of humidifying rollers 231 and 231 are made so that moisture can be held at the outer circumferences thereof. In particular, the humidifying rollers 231 and 231 are made of hydrophilic rubber or the like that can hold moisture. For example, acrylonitrile butadiene rubber (NBR) can be preferably used.

When the humidifying rollers 231 and 231, which form a pair, rotate while a sheet of paper P being sandwiched therebetween in a state where the humidifying rollers 231 and 231 are holding moisture, the sheet of paper P can be humidified as being conveyed to the downstream side. If the humidifying rollers 231 and 231, which form a pair, rotate while a sheet of paper P being sandwiched therebetween in a state where the humidifying rollers 231 and 231 do not hold moisture, they function as regular conveying rollers which convey the sheet of paper P to the downstream side.

In the embodiment, the humidifying rollers 231 and 231, which form a pair, move in the X direction so that they press against each other or separate from each other by being driven by the humidifying roller drive unit (first drive unit) 231*a* (see FIG. 2).

The humidifying roller drive unit 231*a* includes a stepping motor and a gear, for example, and the humidifying rollers 231 and 231 are driven to move by the gear engaging with the rotation of the stepping motor, for example. Other than such method, a technique where the humidifying rollers 231 and 231 are driven to move along a rail by the rotation or winding of a belt, a technique where the humidifying rollers 231 and 231 are driven to move by the alteration in oil pressure or the like can be preferably selected.

The humidifying rollers 231 and 231 are provided with water supply rollers 232 and 232, respectively. Each water supply roller 232 rotates in a state where it is in contact with the outer circumference of its corresponding humidifying roller 231 and in the state where it touches the water pooled in its corresponding reservoir unit 234 to hold moisture at the outer circumference thereof and to transmit moisture to its corresponding humidifying roller 231.

The water supply rollers 232 and 232 are driven by the water supply roller drive unit (the second drive unit) 232*a* (see FIG. 2) to move in the X direction so as to come in contact with or separate from their corresponding humidifying rollers 231 and 231.

The water supply roller drive unit 232*a* includes a stepping motor and a gear, for example, and the water supply rollers 232 and 232 are driven to move by the gear engaging with the rotation of the stepping motor, for example. Other than such method, a technique where the water supply rollers 232 and 232 are driven to move along a rail by the rotation or winding of a belt, a technique where the water supply rollers 232 and 232 are driven to move by the alteration in oil pressure or the like can be preferably selected.

Each of the water removing rollers 233 and 233 is disposed at a position where it can come in contact with the outer circumference of its corresponding water supply roller 232. Each of the water removing rollers 233 and 233 wipes the outer circumference of its corresponding water supply roller 232 when the water supply roller 232 rotates, and thereby the water removing roller 233 can wipe off excess water held at the outer circumference of its corresponding water supplying water 232. In such way, the amount of moisture held at the outer circumferences of the water supply rollers 232 and 232 can be adjusted and preferred amount of moisture can be supplied to the humidifying rollers 231 and 231 by the water supply rollers 232 and 232.

The reservoir units 234 and 234 have arc shaped bottoms so as to be in conformity with the outer circumference shape of the water supply rollers 232 and 232, and water is pooled in the arc shaped bottoms. Each water supply roller 232 is arranged so that its outer circumference be lower than the surface of the water pooled in its corresponding reservoir unit 234 but does not come in contact with the arced bottom surface of the reservoir unit 234. In such way, the outer circumference of each water supply roller 232 soaks the water pooled in its corresponding reservoir unit 234 as the water supply roller 232 rotates. The reservoir units 234 are connected to the tank 235 below by the conveyance path 234*a*.

The tank 235 is a container in which water is stored. Water in the tank 235 is sent out to the reservoir units 234 and 234 through the outlet path 234*a* by the operation of a pump (not shown in the drawings). In such way, the amount of water to be pooled in each of the reservoir units 234 and 234 can be maintained at a preferred amount.

Each of the blades 237 and 237 are disposed below its corresponding humidifying roller 231 (on the upper stream side in the sheet conveyance direction) so as to face the nip portion formed by the humidifying rollers 231 and 231. The blades 237 and 237, which form a pair, are plate-like members, their lengths in the Y direction being approximately the same or longer than the length of the humidifying rollers 231 and 231.

The blades 237 and 237 are arranged diagonally in a state where the upper ends thereof are close to each other so that the space between the upper ends is smaller than the space between the lower ends.

The blades 237 and 237 can rotate in the directions shown by the double pointed arrows A in FIG. 4 with the lower ends thereof being the rotary shafts by being driven by the blade drive unit (the third drive unit) 237*a*.

Therefore, in the state where the blades 237 and 237 are horizontal, they are apart from the humidifying rollers 231 and 231, and as they become vertical, their upper ends come in contact with the humidifying rollers 231 and 231.

When each of the blades 237 and 237 is at an angle being in contact with its corresponding humidifying roller 231, that is, when the blades 237 and 237 be in the state where the upper ends thereof come in contact with the outer circumferences of the humidifying rollers 231 and 231, the blades 237 and 237 function as the water removing units which wipe off the moisture on the outer circumferences of the humidifying rollers 231 and 231.

A blade drive unit 237*a* includes a stepping motor, for example, and the rotary shafts which are the lower ends of the blades 237 and 237 are made to rotate by the rotation of the stepping motor, for example. Here, the blade drive unit 237*a* is not limited to have the above configuration as long as the blades 237 and 237 are made to rotate.

The sensor 236 is disposed at a predetermined position on the upper stream side in the conveyance direction of sheets of paper P further upper than the nip portion formed by the humidifying rollers 231 and 231. The sensor 236 determines whether a sheet of paper P is conveyed to the predetermined position and outputs a detection signal to the second controller 270.

In the embodiment, the humidifying process is performed on the basis of a paper condition in the above described humidifying unit 230 under the control of the second controller 270. Details of the humidifying process will be described later.

Returning to FIG. 3, the second conveyance unit 240 conveys a sheet of paper P which is introduced in to the first paper processing apparatus 200 through the introducing unit 210 to the lower stream side of the humidifying unit 230 without conveying the sheet of paper P through the humidifying unit 230. That is, the second conveyance unit 240 conveys a sheet of paper P, which was branched toward the second conveyance unit 240 without branching toward the humidifying unit 230 at the branching point Q1 in the first conveyance unit 220, to the meeting point Q2 arranged on the down stream side of the humidifying unit 230.

The decurling unit 250 is a mechanism for correcting curling of a sheet of paper P while conveying the sheet of paper P. The decurling unit 250 includes a first decurling unit 10, a second decurling unit 20 and a third decurling unit 30.

The first decurling unit 10 and the second decurling unit 20 are for correcting large curling of a sheet of paper P. The first decurling unit 10 conveys a sheet of paper P which is conveyed from below to the right direction, and the second decurling unit 20 conveys the sheet of paper P, which is conveyed from the right side, upward.

The third decurling unit 30 is for correcting small curling of a sheet of paper P. In the third decurling unit 30, sandwiching force is applied to a sheet of paper P from both the left and right sides while conveying the sheet of paper P upward from below.

An outlet 260 includes a curved conveyance unit which receives a sheet of paper P which is conveyed from the third decurling unit 30 of the decurling unit 250, conveys the sheet of paper P downward from above and conveys the sheet of paper P to the left direction. The outlet 260 conveys a sheet of paper P to the second paper processing apparatus 300 via the curved conveyance unit.

As described above, in the first paper processing apparatus 200, curved conveyance paths are formed inside the apparatus between the introducing unit 210 and the outlet 260. The curving directions of the curved conveyance paths are not in one direction in order to prevent a sheet of paper P from curling in one direction.

The second controller 270 integrally controls the units in the first paper processing apparatus 200. The second controller 270 includes a CPU, a RAM and the like. The CPU reads a program stored in the second storage 280, opens the program in a work area in the RAM. In such way, the CPU executes various processes in cooperation with programs.

For example, the second controller 270 carries out the humidifying process on a sheet of paper P on the basis of a pre-set paper condition.

In the second storage 280, programs which are to be carried out by the second controller 270 and data necessary for carrying out the programs are stored.

For example, a paper condition for controlling the operation of the humidifying unit 230 of the first paper processing apparatus 200 is stored in the second storage 280. If a user operates the operation display 180 and sets a paper condition for controlling the operation of the humidifying unit 230, the set paper condition is to be stored in the second storage 280.

Figures 5, 6:
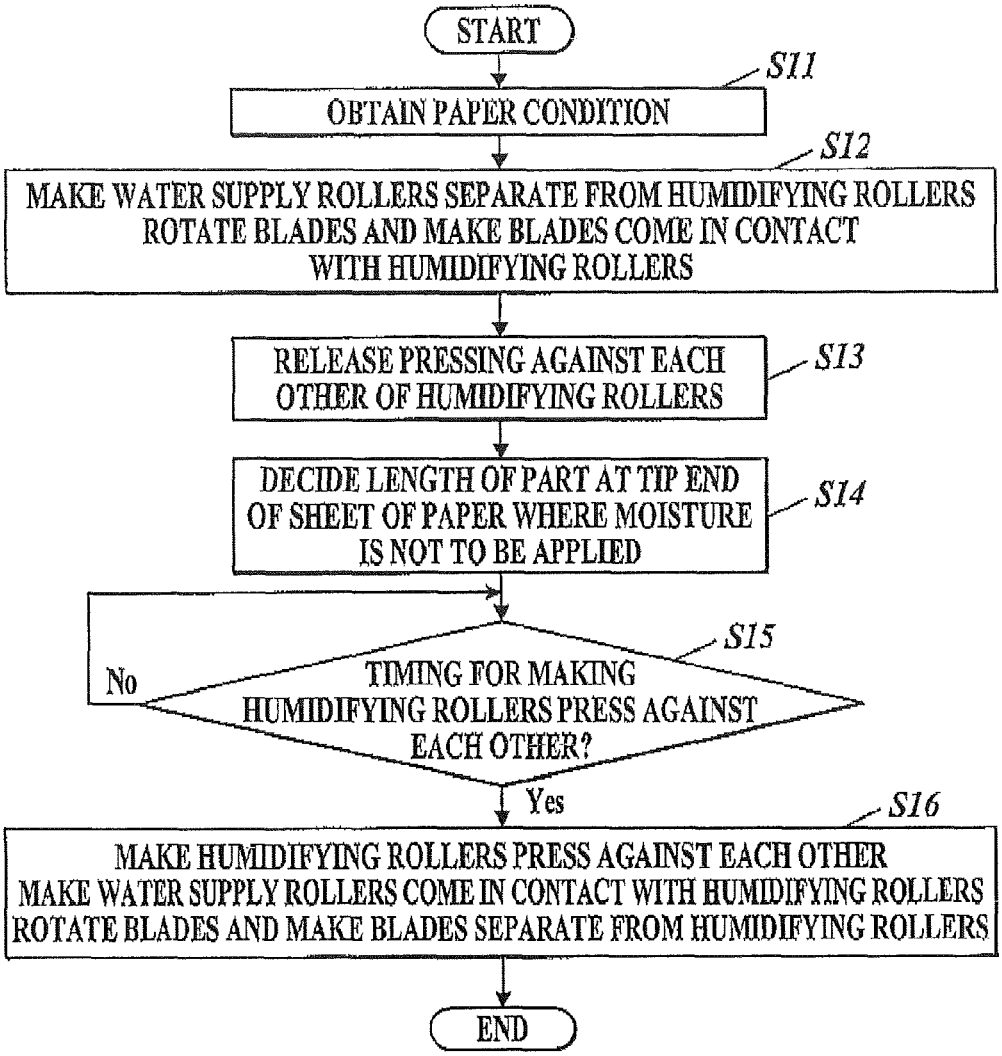
FIG. 5 is an example of a setting table which sets a paper condition that is referred to in a humidifying process.
FIG. 6 is a flowchart showing operation of the humidifying unit in the humidifying process.

FIG. 5 is an example of a setting table T1 which sets a paper condition.

In FIG. 5, basis weight of sheets of paper P and lengths of parts where moisture is not to be applied at the tip ends of sheets of paper P corresponding to the basis weight are set as the paper condition.

In particular, if the basis weight of a sheet of paper P is 50 to 60 g/m2, the length of the part at the tip end of the sheet of paper P where moisture is not to be applied is 10 mm. If the basis weight of a sheet of paper P is 61 to 70 g/m2, the length of the part at the tip end of the sheet of paper P where moisture is not to be applied is 5 mm. If the basis weight of a sheet of paper P is 71 g/m2 or greater, the length of the part at the tip end of the sheet of paper P where moisture is not to be applied is 0 mm (humidifying of the sheet of paper P starts from the very tip).

The setting shown in FIG. 5 is just an example and the setting can be changed as needed. A user can change the numbers set in the setting table T1 by operating the operation display 180. If the numbers set in the setting table T1 are changed, the operation timing of the pair of humidifying rollers 231 and 231 are changed in accordance with the setting change, and further, the operation timing of the water supplying rollers 232 and 232 and the blades 237 and 237 is also changed accordingly.

It is needless to say that the configuration may be such that allows a user to operate the operation display 180 to preferably change the operation timing of the water supplying rollers 232 and 232 and the blades 237 and 237.

Further, any one of type, thickness and the like of sheets of paper P or any combination thereof can be used as the paper condition other than basis weight.

Here, the humidifying process performed in the humidifying unit 230 of the first paper processing apparatus 200 will be described.

FIG. 6 is a flowchart showing operation of the humidifying process that is performed in the humidifying unit 230.

Figure 7:
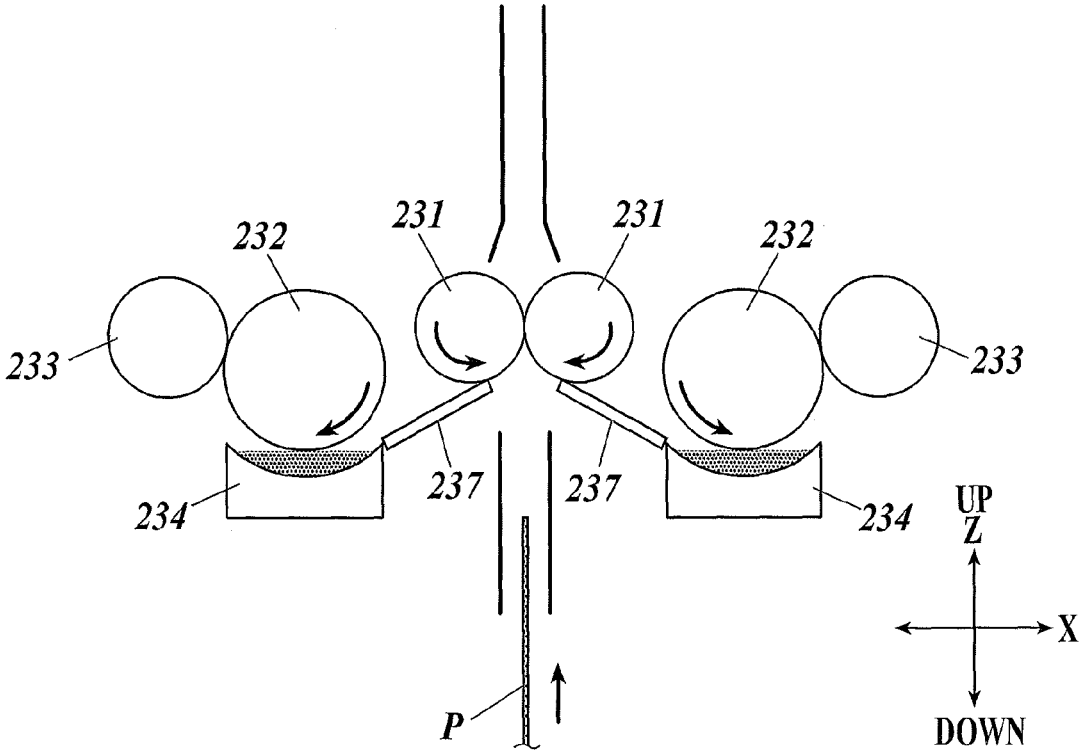
FIG. 7 is a schematic view used for explaining operation of the humidifying unit in the humidifying process.
Figure 8:
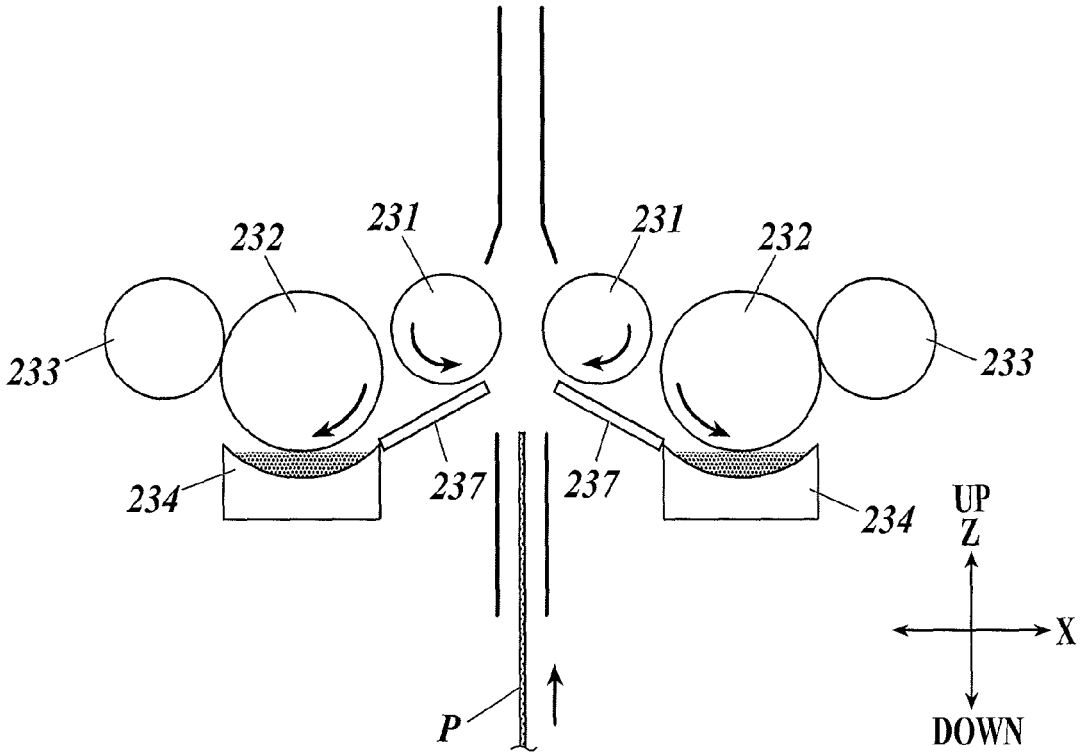
FIG. 8 is a schematic view used for explaining operation of the humidifying unit in the humidifying process.
Figure 9:
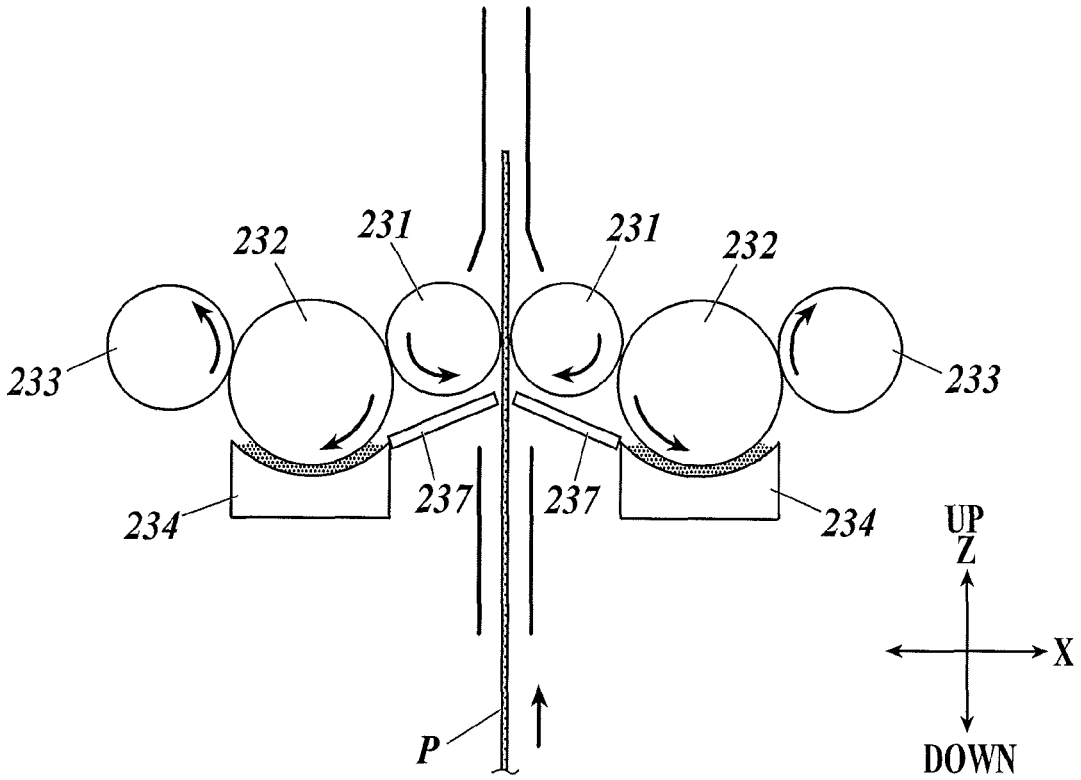
FIG. 9 is a schematic view used for explaining operation of the humidifying unit in the humidifying process.
Figure 10:
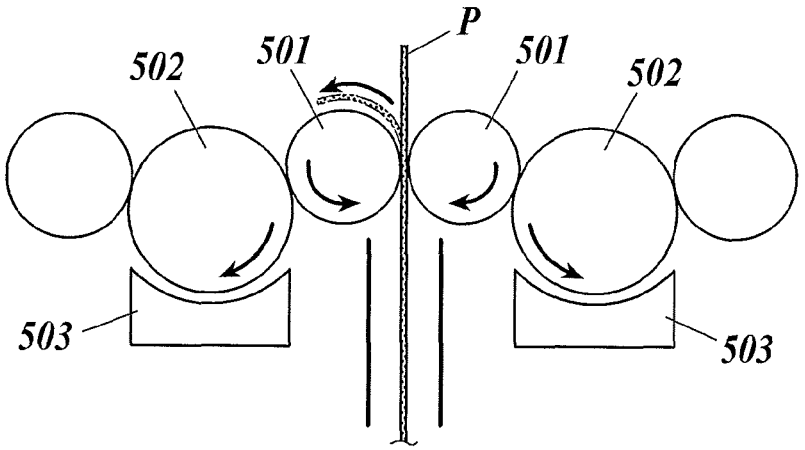
FIG. 10 is a view used for explaining a problem in a conventional technique.

FIGS. 7 to 9 are schematic views showing different states of the humidifying unit 230 during the humidifying process.

As premises for the process, the humidifying rollers 231 and 231, which form a pair, are made to press against each other, and one humidifying roller 231 and its corresponding water supply roller 232 are made to press against each other and the other humidifying roller 231 and its corresponding water supply roller 232 are made to press against each other. A sheet of paper P is expected to be conveyed upward from below at a predetermined constant conveyance speed.

First, the second controller 270 obtains a paper condition (the basis weight of a sheet of paper P) included in job information (step S11).

Next, the second controller 270 makes the water supply roller driving unit 232*a* drive the water supply rollers 232 and 232 so as to separate from the humidifying rollers 231 and 231 and makes the blade drive unit 237*a* drive the blades 237 and 237 so as to rotate in the direction approximating the vertical state in order to make the blades 237 and 237 come in contact with their corresponding humidifying rollers 231 and 231 (see FIG. 7, step S12).

In such way, moisture supply to the humidifying rollers 231 and 231 from the water supply rollers 232 and 232 is cut off and the upper ends of the blades 237 and 237 are to be in contact with the outer circumferences of the humidifying rollers 231 and 231. Thus, moisture on the outer circumferences of the humidifying rollers 231 and 231 is wiped off and removed.

Next, after a predetermined time elapses, the second controller 270 makes the humidifying roller drive unit 231*a* drive the humidifying rollers 231 and 231 so as to release their pressing against each other (the humidifying rollers 231 and 231 are made to separate from each other) (see FIG. 8, step S13).

Since the blades 237 and 237 are arranged diagonally, the humidifying rollers 231 and 231 and their corresponding blades 237 and 237 are to be in a state where they are not in contact with each other as a result of releasing of the pressing against each other of the humidifying rollers 231 and 231. In such way, the humidifying rollers 231 and 231 can be prevented from wearing out due to being in contact with the blades 237 and 237.

According to the embodiment, it is controlled so as to first separate the water supply rollers 232 and 232 from their corresponding humidifying rollers 231 and 231 in step S12 and then, release the pressing against each other of the humidifying rollers 231 and 231 in step S13. In such way, water can be prevented from dripping when separating the humidifying rollers 231 and 231 from each other since operation timing is different for individual rollers.

Next, the second controller 270 refers to the setting table T1 stored in the second storage 280 and sets the length of the part at the tip end of a sheet of paper P where water is not to be applied on the basis of the paper condition (the basis weight of a sheet of paper P) obtained in step S11 (step S14).

Here, the second controller 270 calculates the time needed until the humidifying rollers 231 and 231 are to be made to press against each other again after the tip end of a sheet of paper P passes the sensor 236 on the basis of the length which is set by referring to the setting table T1 and the predetermined sheet conveyance speed.

Next, the second controller 270 determines whether the time has reached the timing to make the humidifying rollers 231 and 231 press against each other since the tip end of a sheet of paper P passed the sensor 236, that is, whether the tip end of a sheet of paper P has passed a predetermined distance from the position corresponding to the nip portion formed by the humidifying rollers 231 and 231 (step S15). If the time has not yet reached the timing to make the humidifying rollers 231 and 231 press against each other (step S15: No), the process of step S15 is to be repeated.

If it is determined that the time has reached the timing to make the humidifying rollers 231 and 231 press against each other (step S15: Yes), the second controller 270 makes the humidifying roller drive unit 231*a* drive the humidifying rollers 231 and 231 so as to press against each other, makes the water supply roller drive unit 232*a* drive the water supply rollers 232 and 232 so as to be in contact with the humidifying rollers 231 and 231, makes the blade drive unit 237*a* drive the blades 237 and 237 so as to rotate in the direction approximating the horizontal state to separate the blades 237 and 237 from the humidifying rollers 231 and 231 (see FIG. 9, step S16) and ends the process.

In such way, moisture is supplied to the humidifying rollers 231 and 231 by the water supply rollers 232 and 232 and this initiates supplying of moisture to a sheet of paper P by the humidifying rollers 231 and 231.

At this time, since the blades 237 and 237 are made to rotate in the direction approximating the horizontal state, the blades 237 and 237 do not come in contact with their corresponding humidifying rollers 231 and 231, and moisture supply to a sheet of paper P by the humidifying rollers 231 and 231 will no be blocked.

By the above described humidifying process, a sheet of paper P is to be in a state where moisture is applied thereto except for the tip end part thereof and is to be conveyed to the down stream side of the humidifying unit 230.

[Second Paper Processing Apparatus]

Returning to FIG. 1, the second paper processing apparatus 300 includes a first conveyance path 310, a second conveyance path 320, a switching member 330, paper output trays 340A and 340B, a third controller 350 and a third storage 360, for example.

The first conveyance path 310 is also called the straight path and includes a plurality of rollers and drive units (not shown) which drive individual rollers, for example. The first conveyance path 310 conveys sheets of paper P.

A hole punch unit 311 which punches holes in sheets of paper P is arranged on the first conveyance path 310, for example.

The second conveyance path 320 is also called the stack path and, similarly to the first conveyance path 310, includes a plurality of rollers and drive units (not shown) which drive individual rollers, for example. The second conveyance path 320 conveys sheets of paper P.

On the second conveyance path 320, a stacker 321 where sheets of paper P are to be temporarily stacked, an aligning member 322 which aligns the width of the sheets of paper P stacked on the stacker 321, a binding unit 323 which binds the sheets of paper P stacked on the stacker 321 with needles and a folding unit 324 which folds the sheets of paper P stacked on the stacker 321 are arranged, for example.

The switching member 330 guides the conveying direction of sheets of paper P, switching the conveying path of sheets of paper P between the first conveyance path 310 and the second conveyance path 320.

The sheets of paper P which are output from the first conveyance path 310 are to be stacked on the paper output tray 340A. The sheets of paper P which are output from the second conveyance path 320 are to be stacked on the paper output tray 340B.

The third controller 350 integrally controls the units in the second paper processing apparatus 300. The third controller 350 includes a CPU, a RAM and the like. The CPU reads a program which is stored in the third storage 360, opens the program in a work area in the RAM. In such way, the third controller 350 executes various processes in cooperation with programs.

For example, the third controller 350 controls so as to carry out paper processes of the second paper processing apparatus 300 on sheets of paper P according to preset setting conditions.

In the third storage 360, programs to be executed by the third controller 350 and data necessary to execute the programs are stored.

For example, setting conditions and the like relating to paper processes to be carried out in the second paper processing apparatus 300 are stored in the third storage 360.

Configuration of the second paper processing apparatus 300 is not limited to the above described configuration. Other than the above described configuration, the second paper processing apparatus 300 may include a structure for performing paper processing such as cutting, for example.

As described above, according to the embodiment, the present invention includes the humidifying rollers 231 and 231, forming a pair, which form a nip portion by being pressed against each other and apply moisture to a sheet of paper P when sandwiching and conveying the sheet of paper P, a humidifying roller drive unit 231*a* which drives the humidifying rollers 231 and 231 to make them separate from each other or press against each other, and the second controller 270 which controls the humidifying roller drive unit 231*a*. The second controller 270 controls the humidifying roller drive unit 231*a* so as to make the humidifying rollers 231 and 231 separate from each other and, in such state, to receive a sheet of paper P. After the tip of the sheet of paper P passes the position corresponding to the nip portion, the second controller 270 controls the humidifying roller drive unit 231*a* so as to make the humidifying rollers 231 and 231 press against each other to applying moisture to the sheet of paper P.

In such way, a sheet of paper P can be prevented from winding around one of the humidifying rollers 231 and 231 since moisture is not applied to the tip end of the sheet of paper P. Further, the tip of a sheet of paper P can be prevented from being damaged, such as the tip being turned or folded.

Thus, a sheet of paper P to which moisture is applied can be conveyed stably.

Moreover, according to the embodiment, the present invention includes the water supply rollers 232 and 232 which supply moisture to the outer circumferences of the humidifying rollers 231 and 231, the blades 237 and 237 which wipe off the moisture on the outer circumferences of the humidifying rollers 231 and 231, the water supply roller drive unit 232*a* which drives the water supply rollers 232 and 232 so as to separate from or come in contact with their corresponding humidifying rollers 231 and 231, and the blade drive unit 237*a* which drives the blades 237 and 237 so as to separate from or come in contact with the humidifying rollers 231 and 231. Before the humidifying rollers 231 and 231 receive a sheet of paper P, the second controller 270 controls the water supply roller drive unit 232*a* so as to make the water supply rollers 232 and 232 separate from their corresponding humidifying rollers 231 and 231 and controls the blade drive unit 237*a* so as to make the blades 237 and 237 come in contact with their corresponding humidifying rollers 231 and 231 to wipe off the moisture on the humidifying rollers 231 and 231.

In such way, moisture supply to the humidifying rollers 231 and 231 from the water supply rollers 231 and 231 is cut off and the blades 237 and 237 are in a state where the upper edges thereof are in contact with the outer circumferences of their corresponding humidifying rollers 231 and 231. Thus, the moisture held on the outer circumferences of the humidifying rollers 231 and 231 is wiped off and removed.

Therefore, conveyance malfunction due to the tip of a sheet of paper P coming in contact with the humidifying rollers 231 and 231 which are in a state where they are separated from each other but holding moisture can be prevented.

Moreover, according to the embodiment, the second controller 270 controls the water supply roller drive unit 232*a* so as to make the water supply rollers 232 and 232 separate from their corresponding humidifying rollers 231 and 231. Thereafter, the second controller 270 controls the humidifying roller drive unit 231*a* so as to make the humidifying rollers 231 and 231 separate from each other.

In such way, water can be prevented from dripping when separating the humidifying rollers 231 and 231 from each other.

Furthermore, according to the embodiment, after the tip of a sheet of paper P passes a predetermined distance from the position corresponding to the nip portion, the second controller 270 controls the humidifying roller drive unit 231*a* so as to make the humidifying rollers 231 and 231 press against each other.

In such way, an appropriate amount of moisture can be applied to a sheet of paper P.

Moreover, according to the embodiment, the second controller 270 sets the predetermined distance on the basis of the paper condition. In particular, the second controller 270 sets the predetermined distance so as to be longer as the basis weight, which is the paper condition, be smaller.

Thus, the humidifying rollers 231 and 231 can be made to press against each other at an appropriate timing according to the paper condition. In particular, the smaller the basis weight, the later the timing for making the humidifying rollers 231 and 231 press against each other.

In such way, a sheet of paper P can be reliably prevented from being wrapped around one of the humidifying rollers 231 and 231.

Furthermore, according to the embodiment, the blades 237 and 237 do not come in contact with their corresponding humidifying rollers 231 and 231 when the humidifying rollers 231 and 231 are separated from each other.

In such way, the humidifying rollers 231 and 231 can be prevented from being worn out.

Moreover, according to the embodiment, the present invention includes the operation display 180 for a user to operate on and set the operation timing of the humidifying rollers 231 and 231.

In such way, a user can change the operation timing of the humidifying rollers 231 and 231 as he/she wishes.

In the embodiment, as an example of water removing units, the blades 237 and 237 which are disposed below their corresponding humidifying rollers 231 and 231 are described. However, the shape and disposing position of the water removing units are not limited to the above configuration as long as moisture can be removed from the humidifying rollers 231 and 231.

Further, in the embodiment, an example where the blades 237 and 237 be in a state where they are not in contact with their corresponding humidifying rollers 231 and 231 as a result of the humidifying rollers 231 and 231, which are pressed against each other, separate from each other is described in step S13. Alternatively, the blade drive unit 237*a* can control the blades 237 and 237 so as to rotate at the timing when the humidifying rollers 231 and 231 separate from each other so that the blades 237 and 237 be in a state where they do not come in contact with their corresponding humidifying rollers 231 and 231.

Furthermore, in the embodiment, an example where each of the image forming apparatus 100, the first paper processing apparatus 200 and the second paper processing apparatus 300 includes the controller which controls what is carried out inside the apparatus and performs communication with other apparatuses is described. Alternatively, there can be provided only one controller for integrally controlling the entire image forming system 1.

Moreover, in the embodiment, an example where each of the image forming apparatus 100, the first paper processing apparatus 200 and the second paper processing apparatus 300 includes the storage in which settings and the like of the apparatus are stored is described. Alternatively, there can be provided only one storage in which settings of the entire image forming system 1 are to be stored.

What is claimed is:

1. A paper humidifying apparatus, comprising:

humidifying rollers, forming a pair, which are pressed against each other forming a nip portion and which apply moisture to a sheet of paper when sandwiching and conveying the sheet of paper;

a first drive unit which makes the humidifying rollers separate from each other or press against each other; and a controller which controls the first drive unit, wherein the controller controls the first drive unit so as to make the humidifying rollers separate from each other and receive a tip of the sheet of paper, and after the tip of the sheet of paper passes a position corresponding to the nip portion, the controller controls the first drive unit so as to make the humidifying rollers press against each other to apply moisture to the sheet of paper;

wherein after the tip of the sheet of paper passes a predetermined distance from the position corresponding to the nip portion, the controller controls the first drive unit so as to make the humidifying rollers press against each other; and wherein the controller sets the predetermined distance on a basis of a paper condition.

2. The paper humidifying apparatus of claim 1, wherein the controller sets the predetermined distance so as to be longer as a basis weight, which is the paper condition, becomes smaller.

3. The paper humidifying apparatus of claim 1 further comprising an operation unit for a user to set timing of separation of the humidifying rollers.

4. An image forming system, comprising:

an image forming unit for forming an image on a sheet of paper; and the paper humidifying apparatus of claim 1 for humidifying the sheet of paper on which the image is formed by the image forming unit.

5. A paper humidifying apparatus, comprising:

humidifying rollers, forming a pair, which are pressed against each other forming a nip portion and which apply moisture to a sheet of paper when sandwiching and conveying the sheet of paper;

a first drive unit which makes the humidifying rollers separate from each other or press against each other;

a controller which controls the first drive unit, water supply rollers which supply moisture to outer circumferences of the humidifying rollers;

a second drive unit which makes the water supply rollers separate from or come in contact with the humidifying rollers; and wherein the controller controls the first drive unit so as to make the humidifying rollers separate from each other and receive a tip of the sheet of paper, and after the tip of the sheet of paper passes a position corresponding to the nip portion, the controller controls the first drive unit so as to make the humidifying rollers press against each other to apply moisture to the sheet of paper; and wherein before the humidifying rollers receive the sheet of paper, the controller controls the second drive unit so as to make the water supply rollers separate from the humidifying rollers.

6. The paper humidifying apparatus of claim 5, wherein the controller controls the second drive unit so as to make the water supply rollers separate from the humidifying rollers and thereafter, the controller controls the first drive unit so as to make the humidifying rollers separate from each other.

7. The paper humidifying apparatus of claim 5, further comprising:

water removing units which wipe off moisture on the outer circumferences of the humidifying rollers;

a third drive unit which makes the water removing units separate from or come in contact with the humidifying rollers;

wherein before the humidifying rollers receive the sheet of paper, the controller controls the third drive unit so as to make the water removing units come in contact with the humidifying rollers to wipe off the moisture on the humidifying rollers.

8. An image forming system, comprising:

an image forming unit for forming an image on a sheet of paper; and the paper humidifying apparatus of claim 5 for humidifying the sheet of paper on which the image is formed by the image forming unit.

9. The paper humidifying apparatus of claim 7, wherein the water removing units do not come in contact with the humidifying rollers when the humidifying rollers are separated from each other.

* * * * *